US008876633B2

(12) United States Patent
Matsunaga

(10) Patent No.: US 8,876,633 B2
(45) Date of Patent: Nov. 4, 2014

(54) GOLF CLUB HEAD AND GOLF CLUB

(75) Inventor: Kiyofumi Matsunaga, Kobe (JP)

(73) Assignee: SRI Sports Limited, Kobe (JP)

( * ) Notice: Subject to any disclaimer, the term of this patent is extended or adjusted under 35 U.S.C. 154(b) by 227 days.

(21) Appl. No.: 13/454,718

(22) Filed: Apr. 24, 2012

(65) Prior Publication Data

US 2012/0270675 A1 Oct. 25, 2012

(30) Foreign Application Priority Data

Apr. 25, 2011 (JP) ..... 2011-096882

(51) Int. Cl.
*A63B 53/04* (2006.01)
*A63B 53/06* (2006.01)

(52) U.S. Cl.
CPC ..... *A63B 53/0466* (2013.01); *A63B 53/06* (2013.01); *A63B 2053/0433* (2013.01); *A63B 2053/0491* (2013.01)
USPC ..... 473/344; 473/349; 473/338; 473/328; 473/311

(58) Field of Classification Search
USPC ..... 473/338, 344, 311, 328, 349, 305, 312, 473/314
See application file for complete search history.

(56) References Cited

U.S. PATENT DOCUMENTS 7,887,434 B2 * 2/2011 Beach et al. ..... 473/334
2011/0118051 A1 * 5/2011 Thomas ..... 473/328

FOREIGN PATENT DOCUMENTS

JP 2004-8303 A 1/2004

* cited by examiner

*Primary Examiner* — Benjamin Layno
(74) *Attorney, Agent, or Firm* — Birch, Stewart, Kolasch & Birch, LLP

(57) ABSTRACT

An intersection point between a shaft axis Z1 and a sole surface 18 is defined as S1. A point S2, a point S3, and a point S4 are set on the sole surface 18. An intersection point between a straight line passing through a center of gravity of the head and being perpendicular to the horizontal plane and the sole surface 18 is defined as G1. A point R1, a point R2, a point R3, and a point R4 are set on the sole surface 18. A section A1 and a section A2 are set based on the points. An angle between the shaft axis Z1 and a ground plane is defined as θ. The angle θ exists so that at least a point belonging to the section A1 and at least a point belonging to the section A2 are brought into contact with the ground plane.

16 Claims, 9 Drawing Sheets

GOLF CLUB HEAD AND GOLF CLUB

The present application claims priority on Patent Application No. 2011-96882 filed in JAPAN on Apr. 25, 2011, the entire contents of which are hereby incorporated by reference.

BACKGROUND OF THE INVENTION

1. Field of the Invention

The present invention relates to a golf club head and a golf club.

2. Description of the Related Art

Various shapes of a sole have been proposed in a golf club head.

Japanese Patent Application Laid-Open No. 2004-8303 discloses a head with a spherical sole having a convex curved surface in a toe-heel direction and a face-back direction. When the head is set at an address lie angle of 45 degrees to 55 degrees, the spherical sole is partially formed in a plane or a recessed surface brought into contact with a standard surface.

SUMMARY OF THE INVENTION

In recent years, a head with a sole having a complicated shape has been known. Examples of a cause of the complication include diversification of head functions. For example, when a weight is attached to the sole, the shape of the sole may be complicated. When the weight is removable, the shape of the sole tends to be further complicated. In the case of a head having a removable shaft, a hole into which a screw for fixing the shaft is inserted may be formed in the sole. The hole may complicate the shape of the sole. As a result of considering reduction in ground resistance, the shape of the sole may be complicated. The shape of the sole may be complicated also for the reason of design.

On the other hand, the shape of the sole may change the stability of the head at address. The stability relates to a direction of a face at address. It is hard to address a club in which the direction of the face is not stabilized.

It is considered to simplify the shape of the sole in order to enhance the stability of the head at address. However, in this case, a degree of freedom in design of the shape of the sole is reduced.

It is an object of the present invention to provide a golf club having a high degree of freedom in design of the shape of the sole and excellent head stability at address.

A golf club head of the present invention includes a sole surface. A face-back direction is defined as an X direction; a toe-heel direction is defined as a Y direction; an intersection point between a shaft axis and the sole surface is defined as S1; a point on the sole surface separated by 5 mm on an X directional face side from the intersection point S1 is defined as S2; a point on the sole surface separated by 5 mm on a Y directional heel side from the point S2 is defined as S3; a point on the sole surface separated by 5 mm on the Y directional heel side from the intersection point S1 is defined as S4; in the head in a standard condition where the head is placed on a horizontal plane, an intersection point between a straight line passing through a center of gravity of the head and being perpendicular to the horizontal plane and the sole surface is defined as G1; a point on the sole surface having the same X directional position as that of the intersection point G1 and the same Y directional position as that of the intersection point S1 is defined as R1; a point on the sole surface separated by 5 mm on an X directional back side from the point R1 is defined as R2; a point on the sole surface separated by 5 mm on the Y directional heel side from the point R2 is defined as R3; a point on the sole surface separated by 5 mm on the Y directional heel side from the point R1 is defined as R4; a quadrangle region having the intersection point S1, the point S2, the point S3, and the point S4 as apexes is defined as a section A1; a quadrangle region having the point R1, the point R2, the point R3, and the point R4 as apexes is defined as a section A2; and an angle between the shaft axis and a ground plane is defined as θ. At this time, the angle θ (two-section contact lie angle θ) exists so that at least a point belonging to the section A1 and at least a point belonging to the section A2 are brought into contact with the ground plane.

Preferably, the angle θ (two-section contact lie angle θ) exists so that at least a line belonging to the section A1 and at least a line belonging to the section A2 are brought into contact with the ground plane.

A recess may exist at a position on the X directional back side from the section A2 in the sole surface.

Preferably, the golf club head further includes a weight port provided in the recess. A weight body can be attached to the weight port.

Preferably, a shortest distance D1 between the recess and the section A2 is equal to or less than 10 mm.

The recess may exist in the section A2.

A golf club of the present invention includes any one of the heads, a shaft, and a grip.

A golf club having good head stability at address and a high degree of freedom in design of a sole can be obtained.

DESCRIPTION OF THE PREFERRED EMBODIMENTS

Hereinafter, the present invention will be described in detail based on the preferred embodiments with appropriate references to the accompanying drawings.

Figure 1:
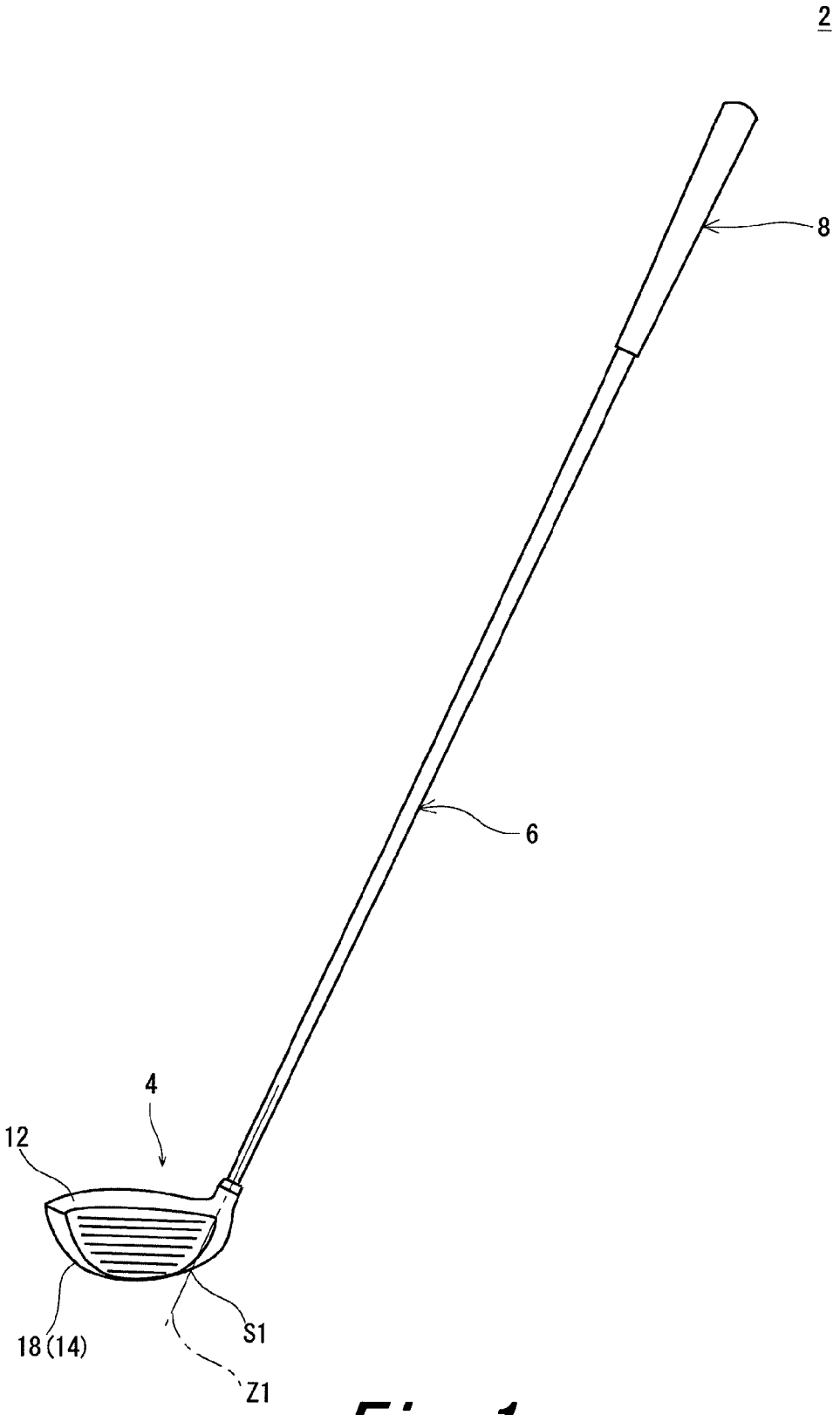
FIG. 1 shows a golf club according to a first embodiment of the present invention.

As shown in FIG. 1, a golf club 2 has a head 4, a shaft 6, and a grip 8.

Figure 2:
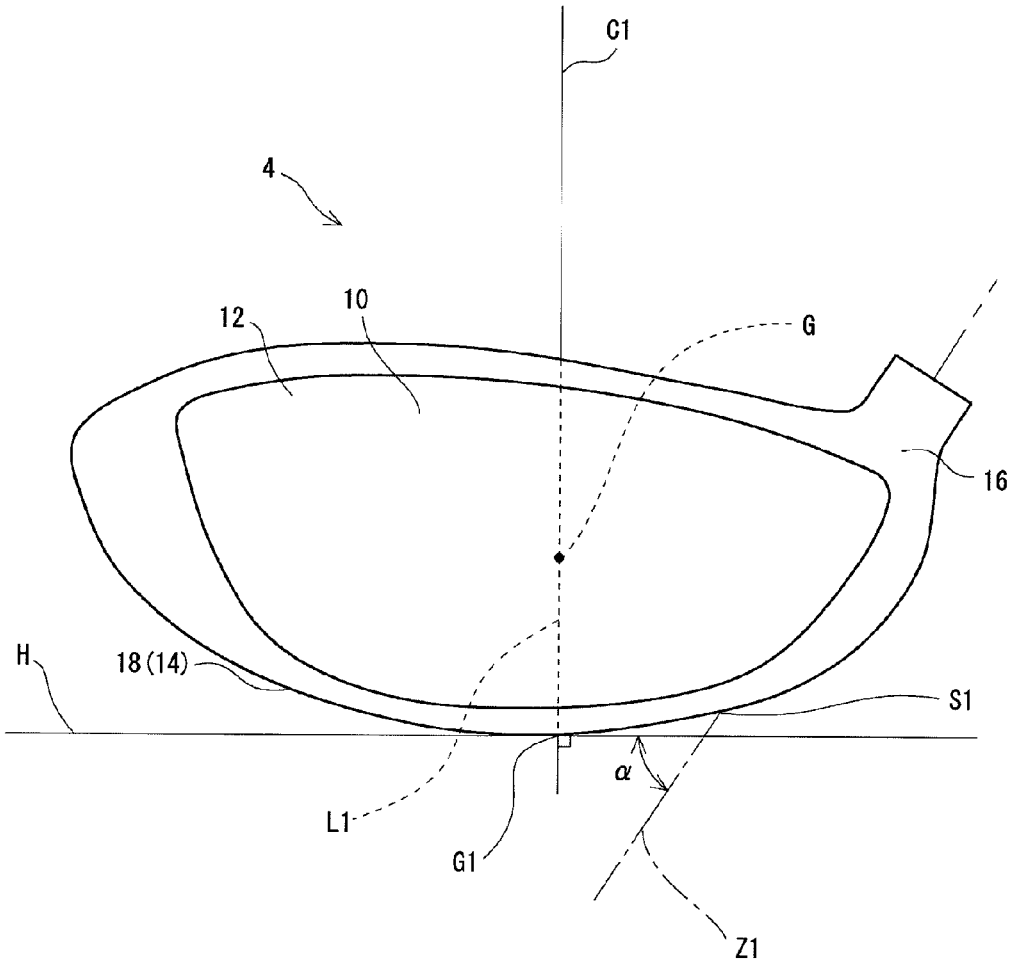
FIG. 2 is a front view of a head according to the first embodiment of the present invention.
Figure 3:
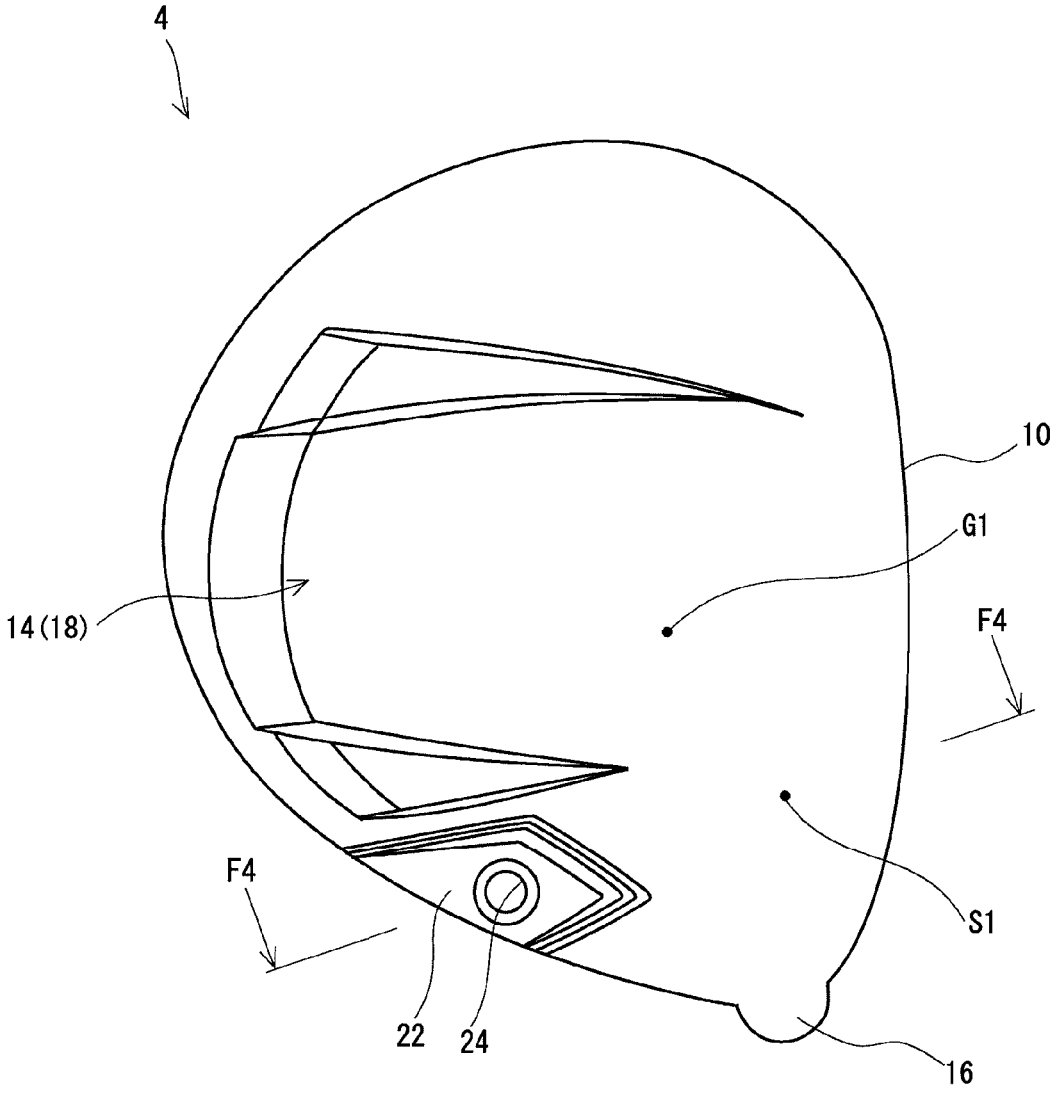
FIG. 3 is a bottom view of the head of FIG. 2.
Figure 4:
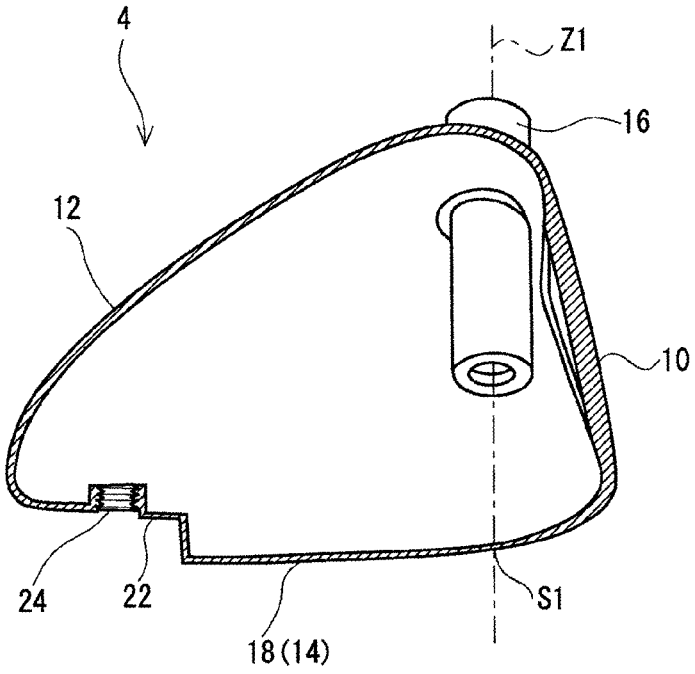
FIG. 4 is a cross-sectional view taken along line F4-F4 of FIG. 3.

FIG. 2 is a front view of the head 4. FIG. 3 is a bottom view of the head 4. FIG. 4 is a cross-sectional view taken along line F4-F4 of FIG. 3. A face line is omitted in FIGS. 2 and 4.

The head 4 has a face 10, a crown 12, a sole 14, and a hosel 16. The crown 12 extends toward the back of the head from the upper edge of the face 10. The sole 14 extends toward the back of the head from the lower edge of the face 10. The head 4 has a hollow structure. The head 4 is a wood type golf club head. The hosel 16 has a hosel hole (not shown). The hosel hole has a central axis Z1. The central axis Z1 is also referred to as a shaft axis Z1.

The sole 14 has a sole surface 18. The sole surface 18 is the external surface of the sole 14.

In the present application, a standard vertical plane, a standard central plane C1, a face-back direction, and a toe-heel direction are defined. A standard condition denotes a state where the shaft axis Z1 is included in a plane P1 perpendicular to a horizontal plane H and the head is placed on the horizontal plane H at a prescribed lie angle $\alpha$ and real loft angle $\beta$. The plane P1 denotes the standard vertical plane. Usually, the prescribed lie angle $\alpha$ and real loft angle $\beta$ of a commercially available club are published in a product catalog, or are expressed on any position of the golf club. The prescribed lie angle $\alpha$ is distinguished from an address lie angle $\theta$ to be described later.

A plane which is perpendicular to the plane P1 and includes a center of gravity G of the head is the standard central plane C1.

In the present application, the toe-heel direction is a direction of an intersection line between the standard vertical plane and the horizontal plane H. In the present application, the toe-heel direction is also referred to as a Y direction.

In the present application, the face-back direction is a direction perpendicular to the toe-heel direction and parallel to the horizontal plane H. In the present application, the face-back direction is also referred to as an X direction.

Figure 5:
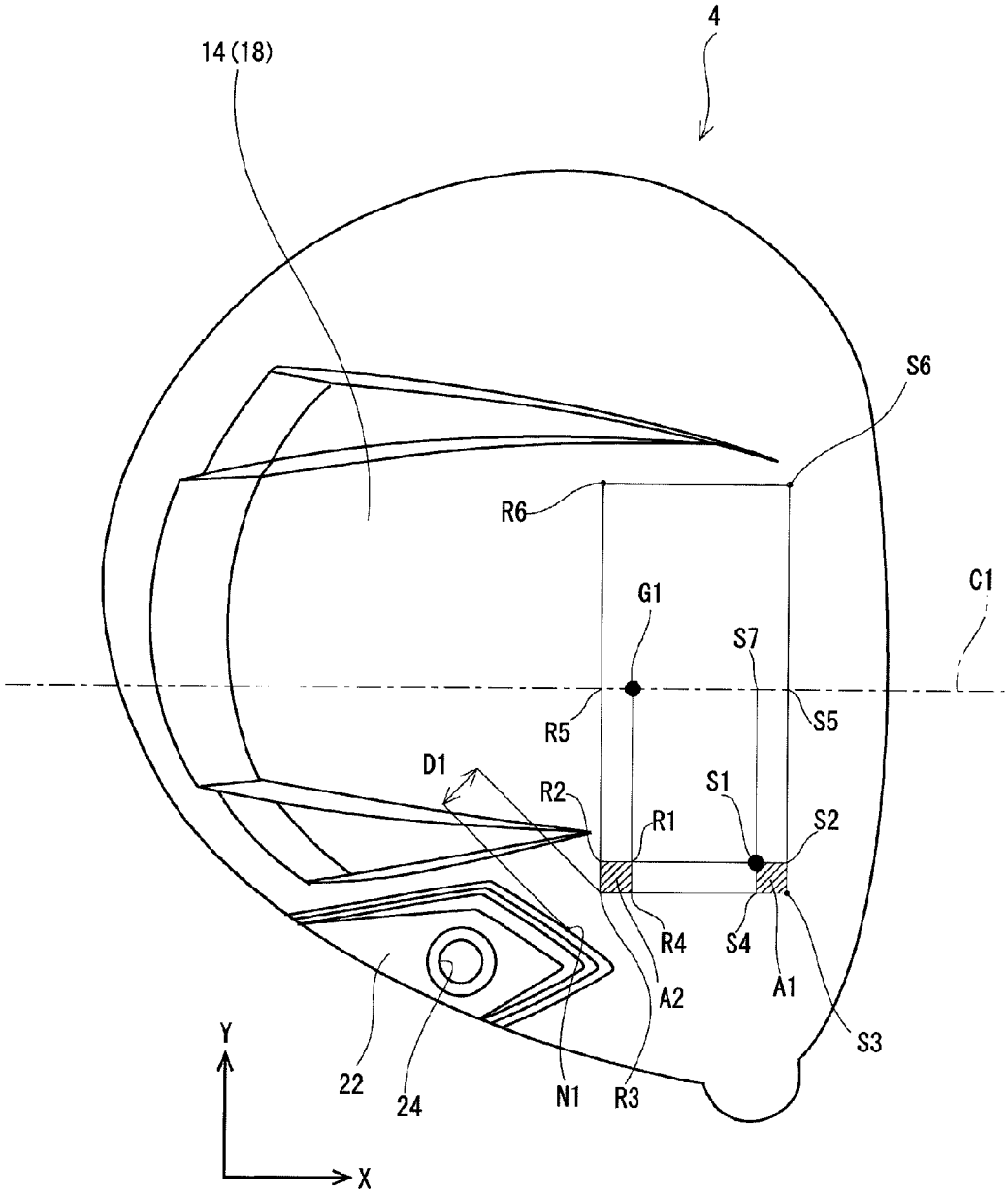
FIG. 5 is the same bottom view as FIG. 3, and describes lines exhibiting sections.
Figure 6:
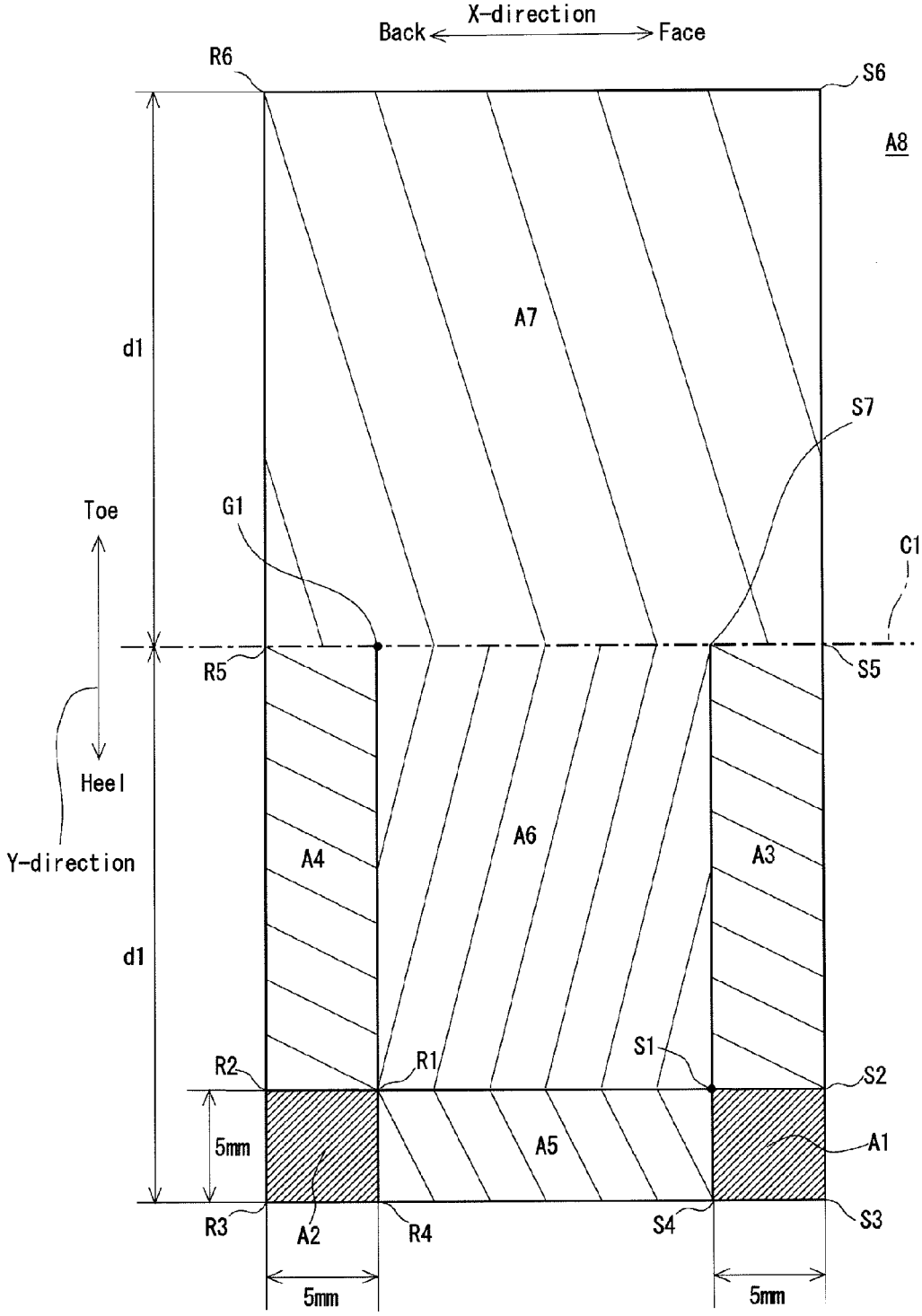
FIG. 6 is an enlarged view for describing points and sections.

In the present invention, the following points are defined in the sole surface. FIG. 5 is a view obtained by adding these points to the bottom view of FIG. 3. FIG. 6 is an enlarged view showing points and sections.

[Intersection Point S1]

An intersection point between the shaft axis Z1 and the sole surface 18 is defined as S1.

[Point S2]

A point on the sole surface 18 separated by 5 mm on an X directional face side from the intersection point S1 is S2.

[Point S3]

A point on the sole surface 18 separated by 5 mm on a Y directional heel side from the point S2 is S3.

[Point S4]

A point on the sole surface separated by 5 mm on the Y directional heel side from the intersection point S1 is S4.

[Point S5]

A point included in an intersection line between the sole surface 18 and the standard central plane C1 and having the same X directional position as that of the point S3 is S5.

[Point S6]

A point on the sole surface 18 separated by d1 (mm) on a Y directional toe side from the point S5 is S6. A Y directional distance between the point S3 and the point S5 is defined as d1 (mm).

[Point S7]

A point included in the intersection line between the sole surface 18 and the standard central plane C1 and having the same X directional position as that of the intersection point S1 is S7.

[Intersection Point G1]

In the head placed in the standard condition on the horizontal plane H, an intersection point between a straight line passing through the center of gravity G of the head and being perpendicular to the horizontal plane H and the sole surface is G1. A straight line L1 (see FIG. 2) connecting the center of gravity G of the head and the intersection point G1 is included in the standard central plane C1.

[Point R1]

A point on the sole surface 18 having the same X directional position as that of the intersection point G1 and the same Y directional position as that of the intersection point S1 is R1.

[Point R2]

A point on the sole surface 18 separated by 5 mm on an X directional back side from the point R1 is R2.

[Point R3]

A point on the sole surface 18 separated by 5 mm on the Y directional heel side from the point R2 is R3.

[Point R4]

A point on the sole surface separated by 5 mm on the Y directional heel side from the point R1 is R4.

[Point R5]

A point included in the intersection line between the sole surface 18 and the standard central plane C1 and having the same X directional position as that of the point R3 is R5.

[Point R6]

A point on the sole surface 18 separated by d1 (mm) on the Y directional toe side from the point R5 is R6.

In the present application, the following sections are defined based on these points. These sections are shown by hatching in FIG. 6.

[Section A1]

A quadrangle region having the intersection point S1, the point S2, the point S3, and the point S4 as apexes is a section A1. The outline of the section A1 has a shortest line connecting the intersection point S1 and the point S2, a shortest line connecting the point S2 and the point S3, a shortest line connecting the point S3 and the point S4, and a shortest line connecting the point S4 and the intersection point S1. The shortest line is a shortest line of lines on the sole surface 18 connecting two points. The "shortest line" is used in place of a "straight line" because a case where the sole surface 18 is not a plane is considered. The other quadrangle region in the present application is also partitioned by a plurality of shortest lines as in the section A1.

[Section A2]

A quadrangle region having the point R1, the point R2, the point R3, and the point R4 as apexes is a section A2.

[Section A3]

A quadrangle region having the intersection point S1, the point S2, the point S5, and the point S7 as apexes is a section A3.

[Section A4]

A quadrangle region having the point R1, the point R2, the point R5, and the intersection point G1 as apexes is a section A4.

[Section A5]

A quadrangle region having the intersection point S1, the point S4, the point R4, and the point R1 as apexes is a section A5.

[Section A6]

A quadrangle region having the intersection point S1, the point R1, the intersection point G1, and the point S7 as apexes is a section A6.

[Section A7]

A quadrangle region having the point S5, the point R5, the point R6, and the point S6 as apexes is a section A7.

[Section A8]

A quadrangle region having the point R6, the point S6, the point S3, and the point R3 as apexes is a section A8. In other words, a section obtained by incorporating the sections A1 to A7 is the section A8.

As shown in FIGS. 3 and 4, the sole surface 18 has a recess 22. A screw hole 24 is formed in the recess 22. The screw hole 24 is a weight port. A weight which is not shown can be attached to the weight port. The position of a center of gravity of the head 4 can be changed by changing the weight of the weight.

The recess in the present application may not be surrounded with a step (see FIG. 4). The recess in the present application may be a groove. The recess includes also a groove indicating a character or a mark or the like.

As shown in FIG. 5, in the sole surface 18 of the head 4, no recess exists in all the sections A1 to A7. In other words, no recess exists in the section A8. No protrusion part exists in the all sections A1 to A7. In other words, no protrusion part exists in the section A8.

In a cross-section along the toe-heel direction (Y direction), the section A8 is a curved surface protruding to the lower side as a whole (see FIG. 2). In a cross-section along the face-back direction (X direction), the section A8 is flat.

An angle between the shaft axis Z1 and a ground plane is defined as θ degree. At this time, in the head 4, the angle θ (two-section contact lie angle θ) exists so that at least a point belonging to the section A1 and at least a point belonging to the section A2 are brought into contact with the ground plane. The angle θ is preferably a lie angle when actually being used. The head 4 is a head of a so-called 1-wood golf club (a driver head).

The ground plane is assumed to be a ground at address. However, the ground plane in the present application means a perfect plane.

A gravitational force acts on the center of gravity G of the head at address. The gravitational force may apply a rotation moment to the head grounded at address. The rotation moment may make the posture of the head at address unstable. The stability of the head at address is also referred to as "sitting". The unstability of the head at address is referred to as "poor sitting". When the sitting is poor, the direction of the face at address becomes unstable. When the sitting is poor, it is hard to address the golf club.

The sections A1 and A2 are simultaneously grounded, and thereby it is found that the posture of the head can be stabilized even if the grounded area is restrictive. The section A2 is located on the X directional back side from the intersection point G1, and the section A1 is located on the X directional face side from the intersection point S1. Furthermore, the section A1 and the section A2 are located on the Y directional heel side from the intersection point S1. The positional relation thereof effectively suppresses the rotation of the head caused by the gravitational force acting on the center of gravity G of the head. Therefore, the posture of the head at address can be stabilized.

The gravitational force acting on the center of gravity G of the head may cause the rotation moment generated around the shaft axis Z1. The rotation moment may make the head at address unstable. The point S1 on the shaft axis Z1 is located between the section A1 and the section A2. The positional relation thereof can effectively suppress the rotation moment around the shaft axis Z1.

The posture stability of the grounded head by grounding in the limited section can improve a degree of freedom in design of the sole surface 18. Both the degree of freedom in design the sole surface 18 and the good sitting of the head are achieved by securing the grounding in the sections A1 and A2 and providing a recessed part or the like in the other section. For example, recesses shown in the following items (a1) to (a11) can be provided while the grounding in the sections A1 and A2 are secured. Therefore, the sole surface 18 having a high degree of freedom in design can be achieved.

(a1) The recess is provided in at least one section selected from the sections A3, A4, A5, A6, and A7.
(a2) The recess is provided in at least one section selected from the sections A3, A4, A5, and A6.
(a3) The recess is provided in at least one section selected from the sections A3, A4, and A5.
(a4) The recess is provided in the section A3 and/or the section A4.
(a5) The recess is provided in the section A5.
(a6) The recess is provided in the section A6.
(a7) The recesses are provided in at least two sections selected from the sections A3, A4, A5, A6, and A7.
(a8) The recesses are provided in at least two sections selected from the sections A3, A4, A5, and A6.
(a9) The recesses are provided in at least two sections selected from the sections A3, A4, and A5.
(a10) The recesses are provided in at least three sections selected from the sections A3, A4, A5, A6, and A7.
(a11) The recesses are provided in at least three sections selected from the sections A3, A4, A5, and A6.

Furthermore, the recess may be provided in the section A1 and/or the section A2. As long as the grounding in the section A1 and the section A2 is secured, the recess may be partially provided in the section A1 and/or the section A2.

For example, protrusion parts shown in the following items (b1) to (b11) can be provided while the grounding in the section A1 and the section A2 is secured. Therefore, the sole surface 18 having a high degree of freedom in design can be achieved.

(b1) The protrusion part is provided in at least one section selected from the sections A3, A4, A5, A6, and A7.
(b2) The protrusion part is provided in at least one section selected from the sections A3, A4, A5, and A6.
(b3) The protrusion part is provided in at least one section selected from the sections A3, A4, and A5.
(b4) The protrusion part is provided in the section A3 and/or the section A4.
(b5) The protrusion part is provided in the section A5.
(b6) The protrusion part is provided in the section A6.
(b7) The protrusion parts are provided in at least two sections selected from the sections A3, A4, A5, A6, and A7.
(b8) The protrusion parts are provided in at least two sections selected from the section A3, A4, A5, and A6.
(b9) The protrusion parts are provided in at least two sections selected from the section A3, A4, and A5.
(b10) The protrusion parts are provided in at least three sections selected from the section A3, A4, A5, A6, and A7.
(b11) The protrusion parts are provided in at least three sections selected from the section A3, A4, A5, and A6.

Furthermore, the protrusion part may be provided in the section A1 and/or the section A2. As long as the grounding in the section A1 and section A2 is secured, the protrusion part may be partially provided in the section A1 and/or the section A2.

In respect of further stabilizing the posture of the head at address, a line contact can be employed in place of the point contact. That is, preferably, the angle θ (two-section contact lie angle θ) exists so that at least a line belonging to the section A1 and at least a line belonging to the section A2 are brought into contact with the ground plane.

In respect of further stabilizing the posture of the head at address, the line of the line contact preferably crosses the section A1. In respect of further stabilizing the posture of the head at address, the line of the line contact preferably crosses the section A2.

Furthermore, in place of the line contact, a face contact may be employed. That is, preferably, the angle θ (two-section contact lie angle θ) exists so that a face constituting at least a part of the section A1 and a face constituting at least a part of the section A2 are brought into contact with the ground plane.

As shown in FIG. 5, the sole surface 18 has the recess 22 on the X directional back side from the section A2. The recess 22 does not inhibit the grounding in the section A1 and section A2. The recess 22 does not inhibit the sitting of the head.

A shortest distance between the recess 22 and the section A2 is shown by a double-pointed arrow D1 in FIG. 5. The shortest distance D1 in the embodiment is a distance between the point R3 and a shortest point N1. The shortest point N1 is a point nearest to the section A2 in the recess 22. Since the sitting is good in the grounding due to the limited section in the embodiment, the sitting is not inhibited even when the recess 22 is near to the section A2. In this respect, the shortest distance D1 is preferably equal to or less than 10 mm, more preferably equal to or less than 7 mm, and still more preferably equal to or less than 5 mm.

As described above, the weight port is provided in the recess 22. Therefore, the weight port can be provided without inhibiting the sitting of the head. The degree of freedom of disposal of the weight port is high. The structure of the weight port is not limited. The weight port preferably enables the attachment and detachment of the weight.

While the weight port is located on the X directional back side from the section A2, the intersection point G1 is located in the end of the section A2 on the X directional face side. The disposal generates balance for a moment around a grounding point in the section A2. That is, a moment due to the gravitational force of the weight provided in the weight port and a moment due to the gravitational force of the head acting on the center of gravity G of the head are canceled each other. Therefore, the rotation moment is decreased, to tend to stabilize the posture of the head.

Figure 7:
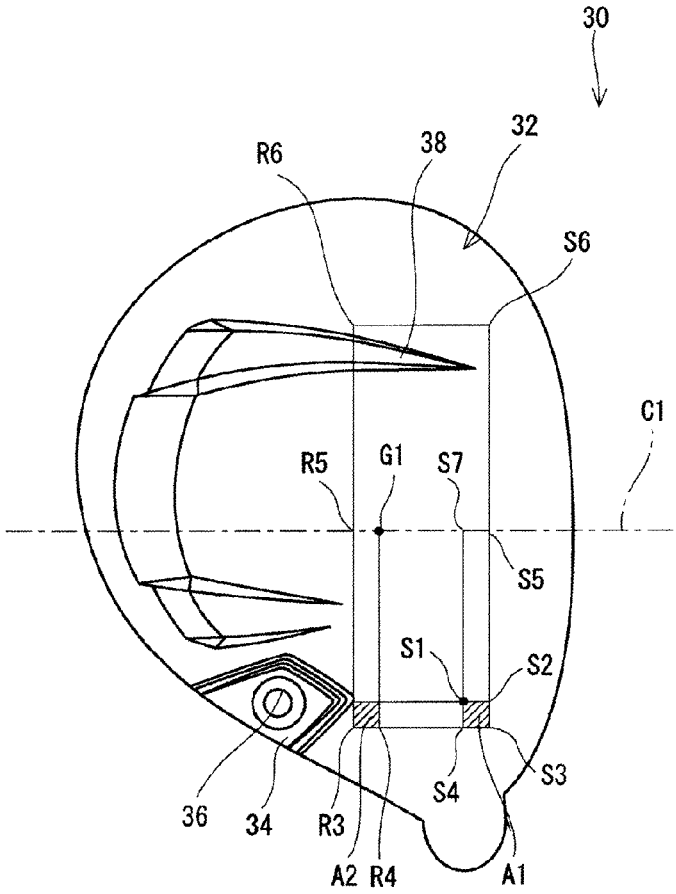
FIG. 7 is a bottom view of a head according to a second embodiment of the present invention, and describes lines exhibiting sections.

FIG. 7 is a bottom view of a head 30 according to a second embodiment. The head 30 has a sole surface 32. The sole surface 32 has the above-mentioned sections A1 to A8 (see FIGS. 6 and 7). The section A1 and the section A2 are shown by hatching.

In the head 30, the angle θ (two-section contact lie angle θ) exists so that at least a point belonging to the section A1 and at least a point belonging to the section A2 are brought into contact with the ground plane. The angle θ is preferably a lie angle when actually being used. The head 30 is a head of a so-called 3-wood golf club.

The sole surface 32 has a recess 34. The recess 34 has a weight port 36. In the head 30, the shortest distance D1 (not shown) is equal to or less than 2 mm. However, the recess 34 does not inhibit the grounding in the section A1 and the section A2. The recess 34 does not inhibit the sitting of the head.

As shown in FIG. 7, the sole surface 32 has a recess 38 in the section A7. The recess 38 does not inhibit the grounding in the section A1 and the section A2. The recess 38 does not inhibit the sitting of the head.

Figure 8:
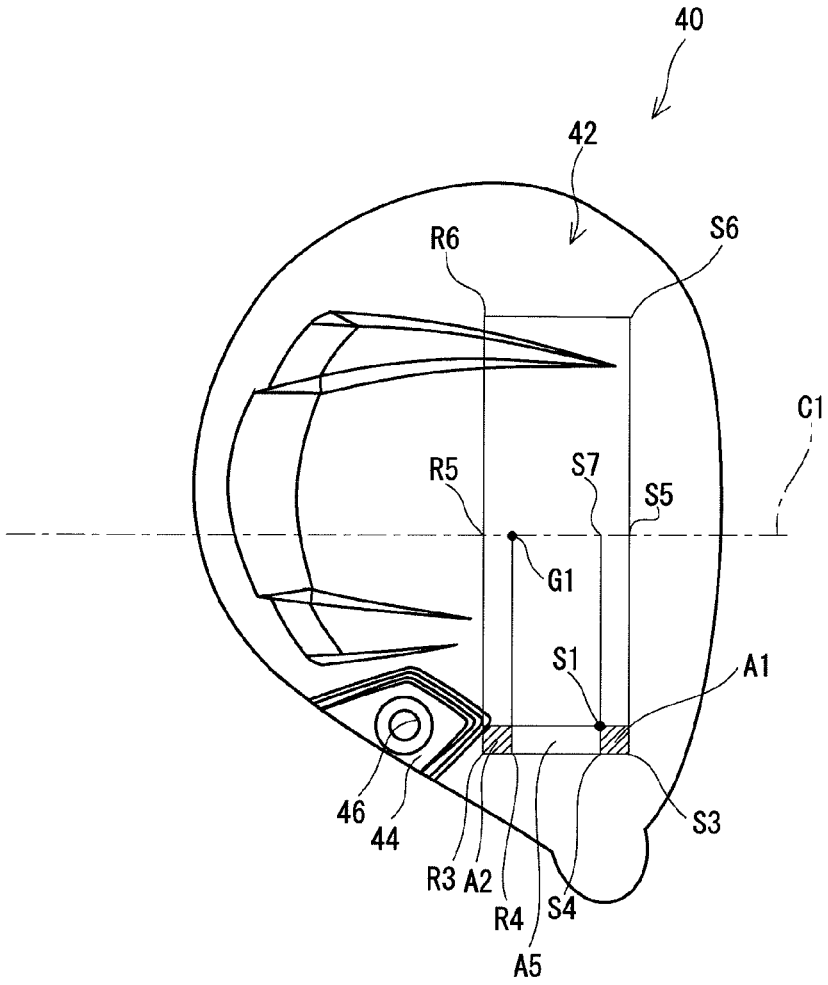
FIG. 8 is a bottom view of a head according to a third embodiment of the present invention, and describes lines exhibiting sections.

FIG. 8 is a bottom view of a head 40 according to a third embodiment. The head 40 has a sole surface 42. The sole surface 42 has the above-mentioned sections A1 to A8 (see FIGS. 6 and 8). The section A1 and the section A2 are shown by hatching.

In this head 40, the angle θ (two-section contact lie angle θ) exists so that at least a point belonging to the section A1 and at least a point belonging to the section A2 are brought into contact with the ground plane. The angle θ is preferably a lie angle when actually being used.

The sole surface 42 has a recess 44. The recess 44 has a weight port 46. In the head 40, the recess 44 exists in the section A2. However, the recess 44 does not inhibit the grounding in the section A1 and the section A2. The recess 44 does not inhibit the sitting of the head.

In the head 40 in which the recess 44 exists in the section A2, the shortest distance D1 is 0 mm.

Furthermore, in the head 40, the recess 44 exists in the section A4. However, the recess 44 does not inhibit the grounding in the section A1 and the section A2.

Figure 9:
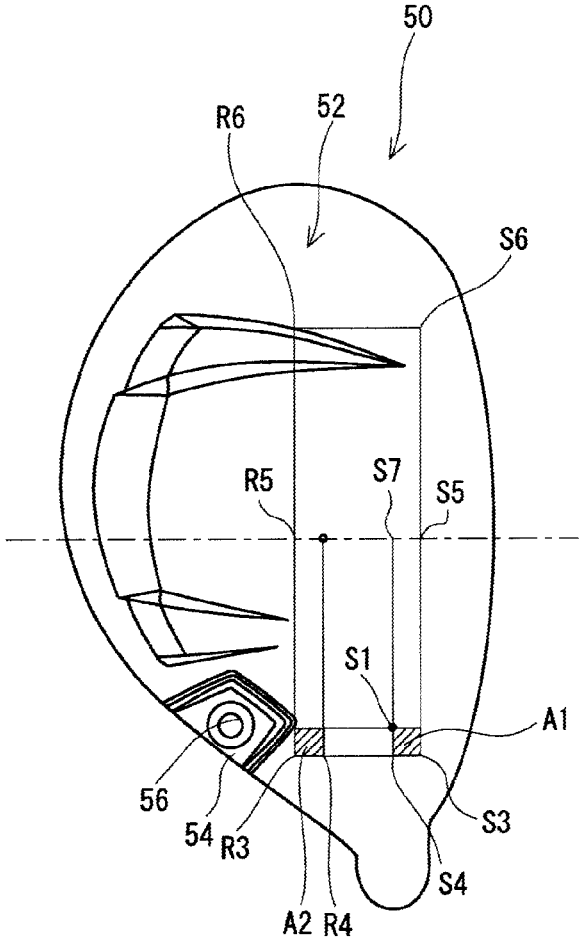
FIG. 9 is a bottom view of a head according to a fourth embodiment of the present invention, and describes lines exhibiting sections.

FIG. 9 is a bottom view of a head 50 according to a fourth embodiment. The head 50 has a sole surface 52. The sole surface 52 has the above-mentioned sections A1 to A8 (see FIGS. 6 and 9). The section A1 and the section A2 are shown by hatching.

In the head 50, the angle θ (two-section contact lie angle θ) exists so that at least a point belonging to the section A1 and at least a point belonging to the section A2 are brought into contact with the ground plane. The angle θ is preferably a lie angle when actually being used.

The sole surface 52 has a recess 54. The recess 54 has a weight port 56. In the head 50, the shortest distance D1 is equal to or less than 2 mm. The recess 54 does not inhibit the grounding in the section A1 and the section A2.

[Angle θ (Two-Section Contact Lie Angle θ)]

The angle θ (two-section contact lie angle θ) is preferably a lie angle when actually being used. The lie angle when actually being used is also referred to as an address lie angle. The address lie angle varies depending to golf players. The angle θ is preferably determined in consideration of many golf players' address lie angles.

The length of the 1-wood golf club (driver) is usually greater than 43.5 inches and 47 inches or less. In the case of the club having the length of greater than 43.5 inches and 47 inches or less, the address lie angle is 50 degrees or greater and 60 degrees or less in many cases. In this respect, in the case of the club having the length of greater than 43.5 inches and 47 inches or less, the angle θ (two-section contact lie angle θ) is preferably 50 degrees, or greater and 60 degrees or less.

The main factor for determining the address lie angle is the club length. The preferable angle θ can be determined based on the club length. The relationship between the preferable angle θ and the club length is as follows.

In the case of the club having the length of 40.0 inches or greater and 47 inches or less, the angle θ (two-section contact lie angle θ) is preferably 50 degrees or greater and 63 degrees or less, and more preferably 50 degrees or greater and 60 degrees or less.

In the case of the club having the length of greater than 43.5 inches and 47 inches or less, the angle θ (two-section contact lie angle θ) is preferably 50 degrees or greater and 60 degrees or less, and more preferably 50 degrees or greater and 57 degrees or less.

In the case of the club having the length of greater than 43.0 inches and 43.5 inches or less, the angle θ (two-section contact lie angle θ) is preferably 50 degrees or greater and 60 degrees or less, and more preferably 50 degrees or greater and 57 degrees or less.

In the case of the club having the length of greater than 42.5 inches and 43.0 inches or less, the angle θ (two-section contact lie angle θ) is preferably 51 degrees or greater and 61 degrees or less, and more preferably 51 degrees or greater and 58 degrees or less.

In the case of the club having the length of greater than 42.0 inches and 42.5 inches or less, the angle θ (two-section contact lie angle θ) is preferably 52 degrees or greater and 62 degrees or less, and more preferably 52 degrees or greater and 59 degrees or less.

In the case of the club having the length of greater than 41.5 inches and 42.0 inches or less, the angle θ (two-section contact lie angle θ) is preferably 53 degrees or greater and 63 degrees or less, and more preferably 53 degrees or greater and 60 degrees or less.

In the case of the club having the length of greater than 41.0 inches and 41.5 inches or less, the angle θ (two-section contact lie angle θ) is preferably 54 degrees or greater and 63 degrees or less, and more preferably 54 degrees or greater and 60 degrees or less.

In the case of the club having the length of greater than 40.5 inches and 41.0 inches or less, the angle θ (two-section contact lie angle θ) is preferably 55 degrees or greater and 63 degrees or less, and more preferably 55 degrees or greater and 60 degrees or less.

In the case of the club having the length of 40.0 inches or greater and 40.5 inches or less, the angle θ (two-section contact lie angle θ) is preferably 56 degrees or greater and 63 degrees or less, and more preferably 56 degrees or greater and 60 degrees or less.

The club length in the present application is measured based on "1c Length" in "1 Club" of the Golf Rules "Appendix II Design of Clubs" defined by R&A (Royal and Ancient Golf Club of Saint Andrews).

The volume of the head is not limited. The sitting poses a problem in the head having a comparatively large volume and a large sole area. In this respect, the volume of the head is preferably equal to or greater than 100 cc, more preferably equal to or greater than 110 cc, and still more preferably equal to or greater than 120 cc. In respect of the golf rule, the volume of the head is preferably equal to or less than 470 cc.

The material of the head is not limited. Examples of the material of the head include a metal and CFRP (carbon fiber reinforced plastic). Examples of the metal used for the head includes one or more kinds of metals selected from pure titanium, a titanium alloy, stainless steel, maraging steel, an aluminium alloy, a magnesium alloy, and a tungsten-nickel alloy. Examples of the stainless steel includes SUS630 and SUS304. Specific examples of the stainless steel includes CUSTOM450 (manufactured by Carpenter Technology Corporation). Specific examples of the titanium alloy includes 6-4 titanium (Ti-6Al-4V), Ti-15V-3Cr-3Sn-3Al, Ti-8Al-1V-1Mo, and Ti-8Al-2V. When the volume of the head is equal to or greater than 300 cc, the titanium alloy is preferable in respect of a strength and rebound performance.

A method for manufacturing the head is not limited. Usually, a hollow head is manufactured by joining two or more members. A method for manufacturing the members constituting the head is not limited. Examples of the method include casting, forging and press forming. The shape of a face member may be a plate shape or a cup shape, for example.

Examples of the structure of the head include a two-piece structure in which two members each integrally formed are joined, a three-piece structure in which three members each integrally formed are joined, and a four-piece structure in which four members each integrally formed are joined. Examples of a method for joining the members include welding, brazing, adhesion, press fitting, and caulking.

EXAMPLES

Hereinafter, the effects of the present invention will be clarified by examples. However, the present invention should not be interpreted in a limited way based on the description of examples.

Example 1

A head body and a face member were welded to obtain a wood type head shown in FIG. 8. The material of the head body was Ti-6Al-4V. A method for manufacturing the head body was a lost-wax precision casting. The material of the face member was Ti-6Al-4V. The face member was obtained by subjecting a rolling plate of Ti-6Al-4V to press processing. The head was a 5-wood. A shaft and a grip were attached to the head to obtain a golf club having a length of 42 inches. The sole surface of the head was made the same as that of the head 40 shown in FIG. 8.

The face-back directional cross-section of a section A8 except for a portion of a recess was a straight line. On the other hand, the toe-heel directional cross-section of the section A8 was a curved line as a whole protruding to the outer side except for the portion of the recess.

In example 1, a recess having a weight port existed in a section A2. However, in this example 1, the angle θ (two-section contact lie angle θ) existed so that a straight line belonging to a section A1 and a straight line belonging to the section A2 were brought into contact with the ground plane. The angle θ was in a range of 56 degrees or greater and 61 degrees or less.

Example 2

A golf club according to example 2 was obtained in the same manner as in example 1 except that a recess was added to a section A5.

In example 2, a recess having a weight port existed in a section A2. Furthermore, a recess existed in a section A5. However, in this example 2, the angle θ (two-section contact lie angle θ) existed so that a straight line belonging to a section A1 and a straight line belonging to the section A2 were brought into contact with the ground plane. The range of the angle θ was the same as that of example 1.

Comparative Example 1

Three-dimensional roundness was applied to a whole section A8 except for a portion of a recess. The roundness was applied in a toe-heel direction, and was also applied in a face-back direction. The section A8 had a substantially spherical shape. The roundness protruded to the outer side of the head. In all the toe-heel directional positions, the cross-section of the section A8 along the face-back direction had roundness. A golf club of comparative example 1 was obtained in the same manner as in example 1 except for above.

When a sole surface was made to abut on a ground plane in a state where an angle between a shaft axis Z1 and the ground plane is θ degree in comparative example 1, a point belonging to a section A1 and a point belonging to a section A2 were not simultaneously brought into contact with the ground plane in all the angles θ due to the roundness.

Comparative Example 2

The whole section A2 was a recess. The recess was continuous to the recess (the recess 44 of FIG. 8) having a weight port. A golf club of comparative example 2 was obtained in the same manner as in example 1 except for above.

In comparative example 2, when a sole surface was made to abut on a ground plane in a state where an angle between a shaft axis Z1 and the ground plane was θ degree, a point belonging to a section A1 and a point belonging to a section A2 were not simultaneously brought into contact with the ground plane in all the angles θ due to the recess.

Example 3

The whole section A5 in comparative example 1 was the recess. A golf club of example 3 was obtained in the same manner as in comparative example 1 except for above.

In example 3, a section A1 and a section A2 could be simultaneously grounded by the recess of the section A5. That is, in this example 2, the angle θ (two-section contact lie angle θ) existed so that a point belonging to the section A1 and a point belonging to the section A2 were brought into contact with the ground plane. The range of the angle θ was the same as that of example 1.

The easiness of addressing for these examples and comparative examples was evaluated.

[Evaluation]

Ten average golf players used each club to evaluate the easiness of addressing. Of the ten golf players, the number of the golf players estimated that it is easy to address the club of example 1 was 7 players; the number of example 2 was 7 players, the number of example 3 was 6 players, the number of comparative example 1 was 1 player, and the number of comparative example 2 was 4 players.

Thus, the evaluation in each of examples is higher than that in each of comparative examples. From the evaluation results, advantages of the present invention are apparent.

The invention described above can be applied to all golf club heads. For example, the present invention can be applied to a driver, a fairway wood, a utility head, a hybrid head, and a hollow iron type head or the like.

The above description is merely illustrative example and various modifications can be made in the scope not to depart from the principal of the present invention.

What is claimed is:

1. A golf club head composed of carbon fiber-reinforced plastic, titanium, a titanium alloy, stainless steel, maraging steel, an aluminum alloy, a magnesium alloy, or a tungsten-nickel alloy, said club head having a volume ranging from 100 cc to 470 cc and comprising a sole surface, wherein a face-back direction is defined as an X direction and a toe-heel direction is defined as a Y direction, said golf club head comprising a section A1 and a section A2, wherein section A1 is defined as a quadrangle region having the intersection point S1, the point S2, the point S3, and the point S4 as apexes, provided that an intersection point between a shaft axis and the sole surface is defined as S1, a point on the sole surface separated by 5 mm on an X directional face side from the intersection point S1 is defined as S2, a point on the sole surface separated by 5 mm on a Y directional heel side from the point S2 is defined as S3, and a point on the sole surface separated by 5 mm on the Y directional heel side from the intersection point S1 is defined as S4, wherein section A2 is defined as a quadrangle region having the point R1, the point R2, the point R3, and the point R4 as apexes, provided that, in the head in a standard condition where the head is placed on a horizontal plane, an intersection point between a straight line passing through a center of gravity of the head and being perpendicular to the horizontal plane and the sole surface is defined as G1, a point on the sole surface having the same X directional position as that of the intersection point G1 and the same Y directional position as that of the intersection point S1 is defined as R1, a point on the sole surface separated by 5 mm on an X directional back side from the point R1 is defined as R2, a point on the sole surface separated by 5 mm on the Y directional heel side from the point R2 is defined as R3, and a point on the sole surface separated by 5 mm on the Y directional heel side from the point R1 is defined as R4, and wherein a recess exists in a position on the X directional back side from the section A2 in the sole surface, the shortest distance D1 between said recess and the section A2 being equal to or less than 10 mm, said golf club head being configured so that, when it is combined with a golf club shaft into a golf club and said club is being employed to address a golf ball during play, an angle between the shaft axis and a ground plane is defined as θ, and the angle θ exists so that at least a point belonging to the section A1 and at least a point belonging to the section A2 are brought into contact with the ground plane, thereby stabilizing the posture of the head at address.

2. The golf club head according to claim 1, wherein the angle θ exists so that at least a line belonging to the section A1 and at least a line belonging to the section A2 are brought into contact with the ground plane.

3. The golf club head according to claim 1, further comprising a weight port provided in the recess, wherein a weight body can be attached to the weight port.

4. The golf club head according to claim 1, wherein the recess exists in the section A2.

5. The golf club head according to claim 1, wherein no protrusion part exists in the section A1, and no protrusion part exist in the section A2.

6. A golf club comprising the head according to claim 1, a shaft, and a grip.

7. The golf club according to claim 6, wherein the golf club has a length of greater than 43.5 inches and 47 inches or less, and the angle θ is 50 degrees or greater and 60 degrees or less.

8. The golf club according to claim 6, wherein the golf club has a length of greater than 43.0 inches and 43.5 inches or less, and the angle θ is 50 degrees or greater and 60 degrees or less.

9. The golf club according to claim 6, wherein the golf club has a length of greater than 42.5 inches and 43.0 inches or less, and the angle θ is 51 degrees or greater and 61 degrees or less.

10. The golf club according to claim 6, wherein the golf club has a length of greater than 42.0 inches and 42.5 inches or less, and the angle θ is 52 degrees or greater and 62 degrees or less.

11. The golf club according to claim 6, wherein the golf club has a length of greater than 41.5 inches and 42.0 inches or less, and the angle θ is 53 degrees or greater and 63 degrees or less.

12. The golf club according to claim 6, wherein the golf club has a length of greater than 41.0 inches and 41.5 inches or less, and the angle θ is 54 degrees or greater and 63 degrees or less.

13. The golf club according to claim 6, wherein the golf club has a length of greater than 40.5 inches and 41.0 inches or less, and the angle θ is 55 degrees or greater and 63 degrees or less.

14. The golf club according to claim 6, wherein the golf club has a length of 40.0 inches or greater and 40.5 inches or less, and the angle θ is 56 degrees or greater and 63 degrees or less.

15. A golf club head according to claim 1, having a recess provided (a1) in at least one section selected from the sections A3, A4, A5, A6, and A7, (a2) in at least one section selected from the sections A3, A4, A5, and A6, (a3) in at least one section selected from the sections A3, A4, and A5, (a4) in the section A3 and/or the section A4, (a5) in the section A5, or (a6) in the section A6, or having recesses provided (a7) in at least two sections selected from the sections A3, A4, A5, A6, and A7, (a8) in at least two sections selected from the sections A3, A4, A5, and A6, (a9) in at least two sections selected from the sections A3, A4, and A5, (a10) in at least three sections selected from the sections A3, A4, A5, A6, and A7, or (a11) in at least three sections selected from the sections A3, A4, A5, and A6, wherein a point S5 is a point included in an intersection line between the sole surface and the standard central plane and having the same X direction position as that of the point S3, a Y directional distance between the point S3 and the point S5 is defined as d1 (mm) and a point S6 is a point on the sole surface separated by d1 (mm) on a Y directional toe side from the point S5, a point S7 is a point included in the intersection line between the sole surface and the standard central plane and having the same X directional position as that of the intersection point S1, a point R5 is a point included in the intersection line between the sole surface and the standard central plane and having the same X direction position as that of the point R3, and a point R6 is a point on the sole surface separated by d1 (mm) on the Y directional toe side from the point R5, and said section A3 is a quadrangle region having the intersection point S1, the point S2, the point S5, and the point S7 as apexes, said section A4 is a quadrangle region having the point R1, the point R2, the point R5, and the intersection point G1 as apexes, said section A5 is a quadrangle region having the intersection point S1, the point S4, the point R4, and the point R1 as apexes, said section A6 is a quadrangle region having the intersection point S1, the point R1, the intersection point G1, and the point S7 as apexes, and said section A7 is a quadrangle region having the point S5, the point R5, the point R6, and the point S6 as apexes.

16. A golf club head according to claim 1, having a protrusion provided (a1) in at least one section selected from the sections A3, A4, A5, A6, and A7, (a2) in at least one section selected from the sections A3, A4, A5, and A6, (a3) in at least one section selected from the sections A3, A4, and A5, (a4) in the section A3 and/or the section A4, (a5) in the section A5, or (a6) in the section A6, or having recesses provided (a7) in at least two sections selected from the sections A3, A4, A5, A6, and A7, (a8) in at least two sections selected from the sections A3, A4, A5, and A6, (a9) in at least two sections selected from the sections A3, A4, and A5, (a10) in at least three sections selected from the sections A3, A4, A5, A6, and A7, or (a11) in at least three sections selected from the sections A3, A4, A5, and A6, wherein a point R5 is a point included in the intersection line between the sole surface and the standard central plane and having the same X direction position as that of the point R3, a Y directional distance between the point S3 and the point S5 is defined as d1 (mm) and a point R6 is a point on the sole surface separated by d1 (mm) on the Y directional toe side from the point R5, a point S5 is a point included in an intersection line between the sole surface and the standard central plane and having the same X direction position as that of the point S3, a point S6 is a point on the sole surface separated by d1 (mm) on a Y directional toe side from the point S5, and a point S7 is a point included in the intersection line between the sole surface and the standard central plane and having the same X directional position as that of the intersection point S1, and said section A3 is a quadrangle region having the intersection point S1, the point S2, the point S5, and the point S7 as apexes, said section A4 is a quadrangle region having the point R1, the point R2, the point R5, and the intersection point G1 as apexes, said section A5 is a quadrangle region having the intersection point S1, the point S4, the point R4, and the point R1 as apexes, said section A6 is a quadrangle region having the intersection point S1, the point R1, the intersection point G1, and the point S7 as apexes, and said section A7 is a quadrangle region having the point S5, the point R5, the point R6, and the point S6 as apexes.

* * * * *